United States Patent [19]

Franco

[11] 3,989,025

[45] Nov. 2, 1976

[54] ROTARY VALVE

[76] Inventor: Daniel Franco, 100 Fairmont St., Arlington, Mass. 02174

[22] Filed: Feb. 18, 1975

[21] Appl. No.: 550,285

[52] U.S. Cl. ..... 123/190 BE; 123/80 BA; 123/190 B; 123/90 BC; 123/190 E

[51] Int. Cl.[2] ..... F01L 7/00

[58] Field of Search..... 123/80 R, 80 BA, 188 AA, 123/190 R, 190 B, 190 BB, 190 BC, 190 BD, 190 BE, 190 D, 190 DL, 190 E, 196 V; 251/368

[56] References Cited

UNITED STATES PATENTS

| | | | |
|---|---|---|---|
| 1,229,602 | 6/1917 | Francis | 123/190 BC |
| 1,447,980 | 3/1923 | Heath | 123/80 BA |
| 1,573,022 | 2/1926 | Wehr | 123/190 BD |
| 1,649,235 | 11/1927 | Jones | 251/368 |
| 1,787,628 | 1/1931 | Jones | 251/368 |
| 1,790,462 | 1/1931 | Congellier | 123/190 BC |
| 2,328,115 | 8/1943 | Wehr | 123/190 BB |
| 2,857,902 | 10/1958 | VanVorst | 123/190 BD |

*Primary Examiner*—Wendell E. Burns
*Assistant Examiner*—David D. Reynolds
*Attorney, Agent, or Firm*—Wolf, Greenfield & Sacks

[57] ABSTRACT

The valve system of this invention is for use on an internal combustion engine having a plurality of pistons slidable in respective cylinders each forming a combustion chamber. The engine comprises a block forming the cylinders and having a head or rotary valve housing mounted to the top of the block. In a multiple cylinder in-line engine design, a shaft is suitably supported extending within the housing and is driven via a timing belt from the crankshaft. A plurality of preferably parabolically shaped rotors are fixedly disposed along the length of the shaft at predetermined intervals with each rotor positioned above a cylinder and received by a bushing of the housing. The shaft is preferably spring loaded at one end and supported by bearings at both ends. Each rotor is constructed of a pressed graphite and has an arcuate recess for providing selective communication between either an inlet port or an exhaust port and a passage in the head leading to the combustion chamber.

18 Claims, 19 Drawing Figures

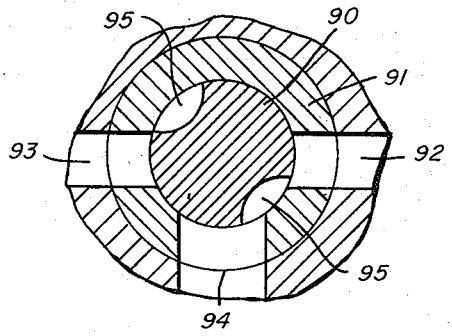
FIG. 8
FIG. 9
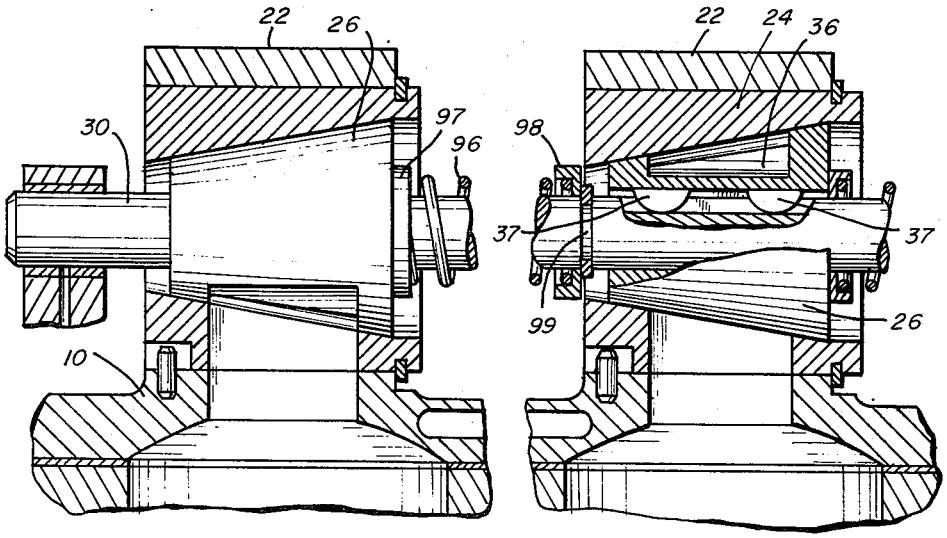

ROTARY VALVE

BACKGROUND OF THE INVENTION

The present invention relates in general to a valve system for an internal combustion engine. More particularly, the present invention relates to a rotary valve system for an internal combustion engine.

The four cycle internal combustion engine presently in use incorporates the reciprocating poppet valve system for the transfer of air and fuel into the combustion chamber and exhaust gases from the combustion chamber. Most of these reciprocating systems involve complicated linkages, cams and springs. In many cases, the number of valve train parts exceeds one third the total number of parts comprising the entire engine. As a result there are horse power losses due to reciprocating inertial losses, cam shaft losses and losses due to valve spring compression.

In an effort to improve the valve system, rotary valves have found some limited use. The rotary valve system contains fewer and simpler parts which are more easy to produce. Due to non-reciprocating rotary motion, the principle retarding effects are frictional due to the sealing and bearing surfaces. Thus, the horse power losses with a rotary valve system are less than with a poppet valve system.

The prior art rotary valve systems are of generally two basic types; disc type or cylindrical type. These valve systems generally incorporate a valve drive shaft for each valve and the valves are lubricated by some external means such as by use of an oil or grease pump. Also, these systems usually incorporate slip rings to aid valve sealing. Alignment problems usually result when single shaft, multible cylinder, in-line rotary systems are used. The primary drawback to these rotary valve systems is that there is excessive use of the lubricating oil when the valve is lubricated properly. If the valve is not lubricated properly then scoring or seizing may occur due to friction and thermal effects.

One well known rotary valve system is referred to as the Aspin design which has met with some success. This design is of conical shape and is co-axially aligned with the cylinder. Also, this valve essentially forms a part of the combustion chamber. Again, one of the drawbacks with this arrangement is that it is difficult to maintain sufficient lubrication between the valve cone and the sealing surfaces without having a high consumption of the lubricating oil. Also, as far as modifying existing engines, it is more difficult when the valve itself forms a major part of the combustion chamber.

Accordingly, one object of the present invention is to provide an improved rotary valve system.

Another object of the present invention is to provide a rotary valve system incorporating a single support shaft for use with an in-line combustion engine.

A further object of the present invention is to provide a rotary valve system wherein the rotor is self-lubricating and self-fitting.

A further object of the present invention is to provide a rotary valve system that provides increased power, efficiency and response in comparison to known valve systems.

Another object of the present invention is to provide a rotary valve system for use with an internal combustion engine wherein the system can be possibly maintained and repaired without requiring removal of the entire head of the engine.

Still another object of the present invention is to provide a rotary valve system for an internal combustion engine that is quiet in operation, simple to design and manufacture, has fewer moving parts than existing systems, and that is less vibrational than existing systems.

SUMMARY OF THE INVENTION

To accomplish the foregoing and other objects of this invention, there is provided a rotary valve system for an internal combustion engine. The engine typically comprises a block defining a plurality of in-line cylindrical combustion chambers. Pistons are slidable individually in each cylindrical combustion chamber and all of the pistons are commonly connected to a crankshaft. The valve system of this invention comprises a plurality of rotors, means for supporting the plurality of rotors in-line with a rotor being associated with and disposed above each combustion chamber, and a housing which is secured to the top of the block and includes means for receiving each of the rotors. In a preferred embodiment the rotors are constructed of a pressed graphite and is made in the form of a parabola. With this arrangement there is no need for external lubrication and the rotor is self-fitting, self-seating, and automatically adjusts for wear or thermal changes by the use of a slight axial load externally applied to the shaft which preferably supports the rotors.

The valve housing is located on the top of the head which forms a part of the combustion chamber and thus by removal of a valve cover the valve system is readily accessible. The axis of the rotary valve shaft is parallel to the crankshaft and is easily driven from the crankshaft. Each rotor, as previously mentioned, is of parabolic shape and has preferably an arcuate recess. The housing is provided with exhaust and inlet ports and as the rotor rotates there is selective communication between either an inlet port or an exhaust port and a passage in the head leading to the combustion chamber.

In accordance with another aspect of the present invention there may be provided in place of the parabolic rotor, a conically shaped rotor. Also, the rotor may be provided with a pair of recesses rather than the single recess. In this case the pair of recesses would be arranged diametrically opposite to each other and be of generally smaller size than the single recess design.

BRIEF DESCRIPTION OF THE DRAWINGS

Numerous other objects, features and advantages of the invention should now become apparent upon a reading of the following detailed description taken in conjunction with the accompanying drawings, in which:

FIG. 8 is a fragmentary view for an alternate embodiment of a valve rotor in accordance with this invention and having two recesses; and FIG. 9 is a cross sectional view similar to that shown in FIG. 1 and showing an alternate embodiment for the rotor.

DETAILED DESCRIPTION

Figure 1:
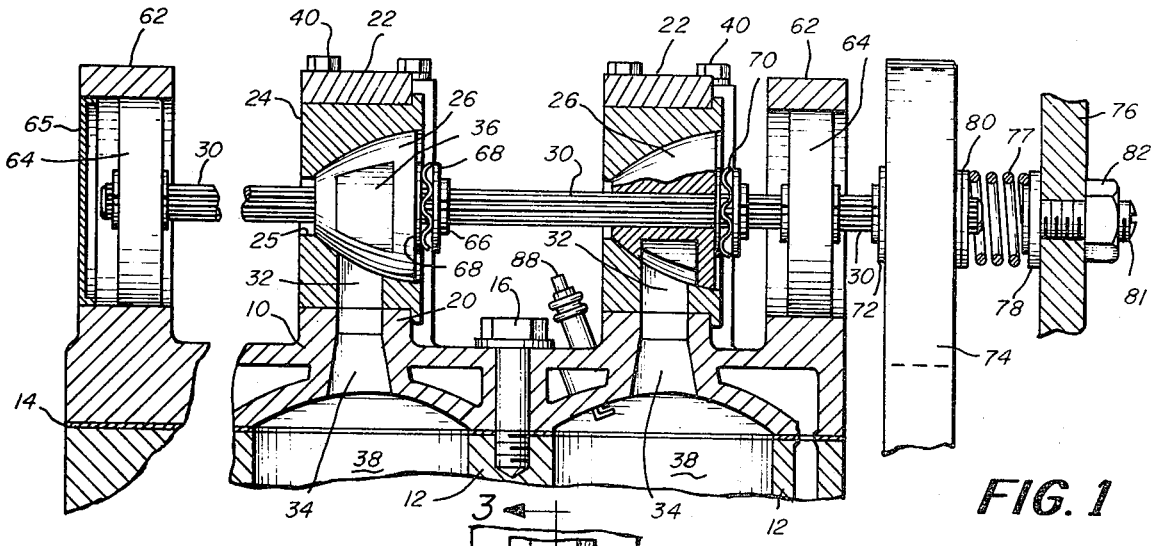
FIG. 1 is a cross sectional view showing the valve system of this invention used with an internal combustion engine.
Figure 2:
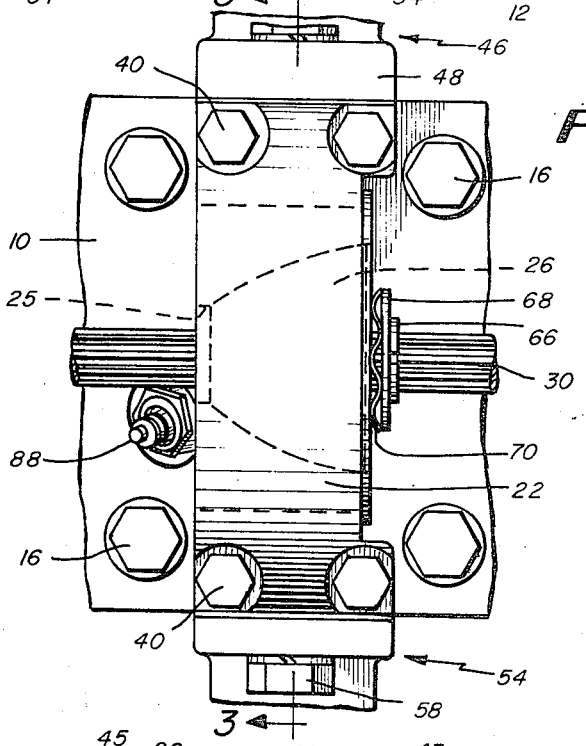
FIG. 2 is a fragmentary plan view of the system shown in FIG. 1.
Figure 3:
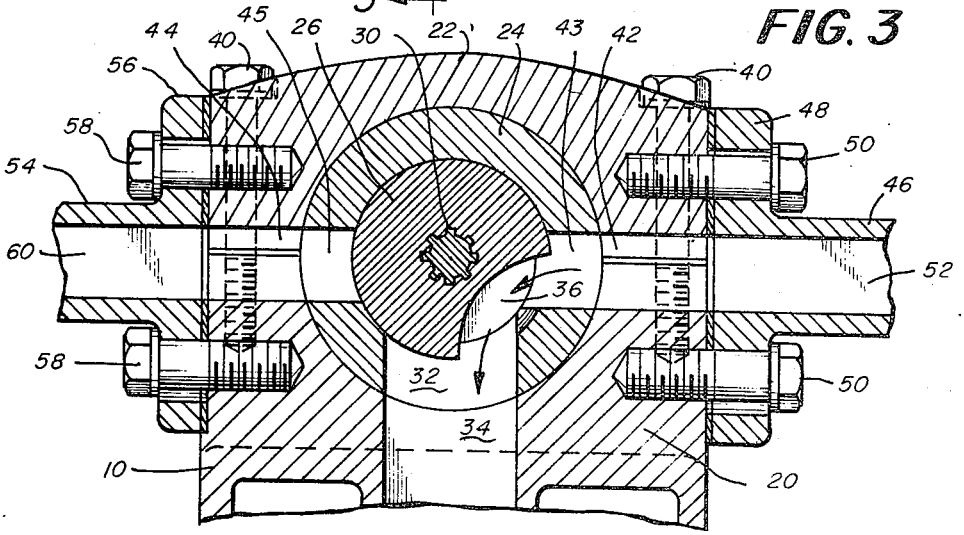
FIG. 3 is a cross sectional view taken along line 3—3 of FIG. 2.

Referring now to FIGS. 1–3, there is shown the rotary valve system of the present invention comprising a housing or head 10 which is secured to the engine block 12. A gasket 14 is disposed between the head and block and the two parts are secured together by plurality of machine bolts 16.

The housing 10 comprises a plurality of spaced upright sections 20 having a top cap 22 associated therewith. The section 20 and the cap 22 have a bushing 24 press fitted thereinto. The section 20 and cap 22 may be constructed of cast iron and the bushing 24 may be constructed of steel. In an alternate embodiment the cap 22 and bushing 24 may be constructed in a single piece with the cap 22 extending downwardly with the rotor 26 in direct contact with the cap.

The rotor 26 shown in FIGS. 1–3 preferably has a paraboloid shape. This is a preferred shape as the radial pressure remains constant for all locations along the rotor. The bushing 24, of course, has a recess that is shaped to receive the paraboloid as shown in FIG. 1. The bushing 24 also includes a through passage 25 for accommodating the shaft 30 which in the preferred embodiment is a splined shaft.

The bushing 24 is also provided with a passage 32 communicating with a passage 34 in the housing 10 and permitting communication between the recess 36 in the rotor and the combustion chamber 38. The shape of the recess in the rotor is shown most clearly in FIG. 3 and has an arcuate shape extending along a predetermined length of the rotor as indicated in FIG. 1.

As previously indicated the section 20 of the housing 10 and the cap 22 accommodate the bushing 24. The section 20 and the cap 22 are secured together by bolts 40 and together define an inlet port 42 communicating with an inlet passage 43 in the bushing, and an outlet port 44 communicating with an outlet passage 45 in the bushing 24. As indicated in FIGS. 2 and 3, an intake manifold 46 having a flange 48 is secured to the cap 22 and section 20 of the housing by means of bolts 50. The manifold 46 defines a passage 52 communicating with the inlet port 42, the passage 43 and the bushing 24 and the recess in the rotor 26. In the position shown in FIG. 3 the rotor is in the intake position and the manifold 46 is connected to the vehicle carburator for passing an air and gas mixture by way of the recess 36 to the combustion chamber 38.

As indicated in FIGS. 2 and 3 there is also shown the exhaust manifold 54 including a flange 56 secured to the cap 22 and the upright section 20 of the housing. The exhaust manifold is secured by means of bolts 58 and the exhaust manifold defines a passage 60 communicating with exhaust port 44 and passage 45. When the rotor 26 has been rotated to the position shown in FIG. 6 the recess 36 permits exhausting of burned gases from the combustion chamber by way of the rotor to the exhaust manifold 54 and from there usually by way of a muffler system to a final exhaust port.

As indicated in FIG. 1 the rotors 26, only two of which are shown in FIG. 1, are supported by a splined shaft 30. The housing 10 may include blocks 62 at opposite ends of the housing each carrying a bearing 64 for suitably supporting the splined shaft 30. A rear bearing plug 65 may provide access to the rear bearing 64. The rotors 26 are each internally splined as shown in FIG. 3 to receive the shaft 30. The shaft 30 is provided with spaced grooves for receiving the snap springs 66. These snap springs are conventional items that are separated to fit onto the shaft and then are self-compressing to fit into the groove on the shaft. A pair of thrust washers 68 are disposed adjacent one side of the snap spring and are separated by a thrust spring 70. The large end of the rotor then rests against one of the thrust washers 68.

The shaft 30 also extends forwardly and carries a timing gear 72 having a timing belt 74 extending thereabout. The belt 74 also extends about another timing gear that is connected to the vehicle crank shaft. These two gears are different in size and designed so that the shaft 30 rotates at one-half the crankshaft speed which is typical for a four cycle internal combustion engine.

One of the important features of the present invention is the concept of applying a variable axial force on the shaft 30. It is noted that in FIG. 1 there is shown a timing gear cover 76 which is fixed relative to the housing 10 and may be attached thereto. A spring 77 extends between a recessed washer 78 and a thrust bearing 80. The adjusting screw 81 and associated nut 82 can be used to move the washer 78 thereby compressing the spring 77 to move the shaft 30 so that the rotors 26 are in intimate contact with the bushings 24. The axial force applied can be varied by adjusting the adjusting screw 81. When the adjustment has been made then the lock nut 82 can be tightened against the timing gear cover. Normally, this adjustment is over a relatively slight range and thus even though the timing gear 72 may move upon movement of the shaft 30 this movement is not great enough to disrupt engagement of the belt 74 with the timing gear.

Although not shown in the drawings, it is also preferred that the valve system shown in FIG. 1 be covered with a valve cover. This valve cover may be secured to the housing 10 in a well known manner and is for protecting the valve system.

The rotor 26, as previously mentioned, is preferably constructed of a pressed graphite and the bushing 24 of a hard steel material. It is noted that there is no requirement for oil lubrication to the rotor and by application of the axial force, the rotor is self seating in its accommodating bushing. Alternatively, the bushing could be constructed of a pressed graphite material and the rotor in that case would be of a hardened steel material.

Figure 4:
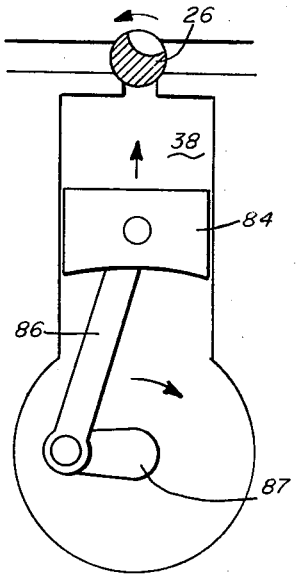
FIGS. 4, 5 and 6 show three different positions for the piston and the corresponding positions of the rotary valve in a schematic fashion.
Figure 5:
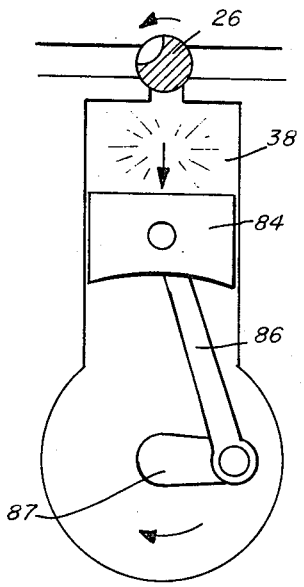
Figure 6:
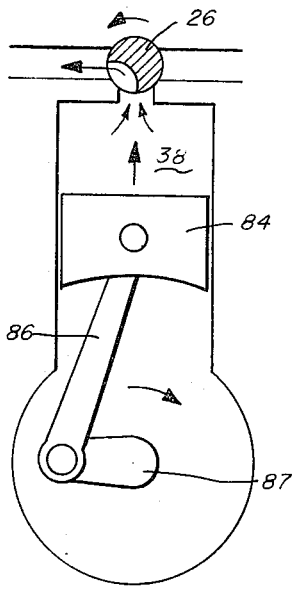

In connection with use in a four cycle engine, the position of the rotor in FIG. 3, as previously mentioned, shows the intake cycle. FIGS. 4–6 show the other three cycles. In these figures there is shown the rotor 26 and the combustion chamber 38. There is also schematically shown the piston 84 which is conventionally coupled by way of a connecting rod 86 to the crankshaft 87.

In FIG. 4 the rotor is rotating in a counter clockwise direction and the piston 84 is sliding upwardly. This is the compression stroke wherein the gas and air mixture are previously coupled into the combustion chamber is now compressed. When the piston 84 is at top dead center the spark plug 88 (see FIGS. 1 and 2) causes an ignition of the mixture in the combustion chamber and the piston 84 is forced downwardly as indicated in FIG. 5. As the crankshaft continues to rotate the piston 84 again moves upwardly as indicated in FIG. 6 and the burned gases in the combustion chamber are forced by way of the rotor 26 to the exhaust port of the valve system. When the piston again moves downwardly, the rotor 26 eventually moves to the position shown in FIG. 3 with communication being between the intake port and combustion chamber.

Figure 7:
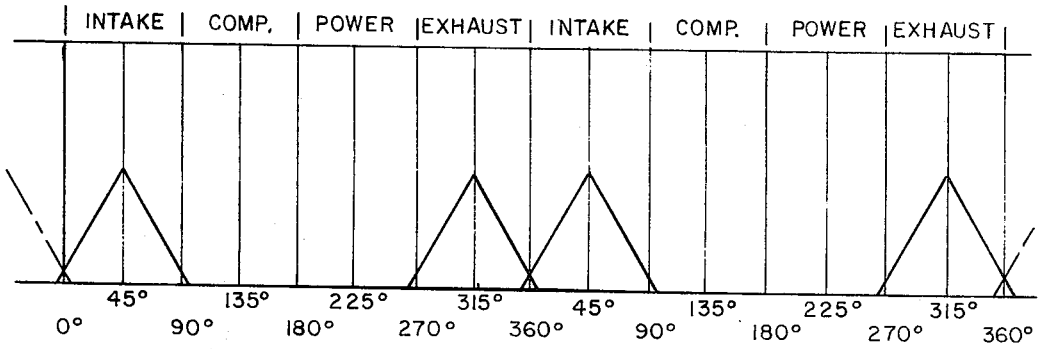
FIG. 7 is a timing diagram associated with the valve mechanism of this invention.

In this connection, reference is now made to the timing diagram of FIG. 7 which identifies each of the four different strokes including the intake, compression, power and exhaust strokes. The exhaust stroke is followed by the intake stroke and it is noted that there is a slight overlap therebetween. In FIG. 7 with the rotary valve system disclosed herein during both the intake and exhaust strokes the opening of the valve (communication via recess 36) is in a linear manner as indicated by the triangular wave form. Thus, the rotor 26 rotates and at an angle of approximately 270° the recess in the valve permits initiation of the exhaust phase. The rotor continues to rotate and at approximately 315° the valve is in its maximum open position. Upon further rotation of the rotor the size of the exhaust port decreases linearly and exhaust terminates at an angle slightly greater than 360°. The recess in the rotor is designed so that the intake port starts to open slightly before 360° and there may be an overlap of approximately 10° between the termination of the exhaust stroke and the commencement of the intake stroke. The intake wave form as noted in FIG. 7 is substantially identical in shape to the exhaust wave form with the rotor rotating to a full open position for the intake and then further rotation causing a closing of the intake at an angle of approximately 90°.

FIG. 8 shows a fragmentary cross section view of an alternate rotor 90. This view is similar to that shown in FIG. 3 with the rotor being accommodated by a bushing 91. The arrangement in FIG. 8 shows an intake passage 92, an exhaust passage 93 and a passage 94 leading to the combustion chamber. In this embodiment, the rotor 90 has two recesses 95 which are arranged diametrically opposite to each other. These recesses are about the same size as the recess 36 shown in FIG. 3 but the rotor in FIG. 8 is larger. In the position shown in FIG. 8, one of the recesses 95 is in its intake position. As the rotor continues to rotate through the compression and power strokes, thereafter the opposite recess 95 is then in a position for exhausting. With the arrangement shown in FIG. 8 the timing gear set up is altered as the rotor is designed to rotate at only one-fourth of the crankshaft speed.

In the embodiment of the rotor shown in FIG. 3, the recess may extend along a cord of the rotor of approximately 100°–110°. In the embodiment shown in FIG. 8 each of the recesses may extend individually along a chord of approximately 50°–55°.

FIG. 9 shows a fragmentary view of a slightly different embodiment for the rotor 26 shown in FIGS. 1–3. In FIG. 9 like reference characters will be used to identify parts like those disclosed in the preferred embodiment. Thus, FIG. 9 shows the housing 10, shaft 30, cap 22, bushing 24 and rotor 26. In this arrangement the rotor 26 is of conical shape and includes a recess 36. In this arrangement the shaft 30 is not splined but instead is keyed to the rotor means of a pair of keys 37 which are shown in the cut-a-way portion of FIG. 9. The rotors are urged into a seated position in the bushings by means of a spring 96 which rests at one end against a washer 97 which in turn rests against the large end of the rotor 26. The other end of the spring sits within a recessed washer 98 which is limited by means of the snap ring 99 which fits within a groove of the shaft 30.

Having described a limited number of embodiments of the present invention, it should now become apparent to those skilled in the art that there are numerous modifications that can be made in the disclosed embodiments all of which are contemplated as falling within the spirit and scope of the present invention as defined by the appended claims.

What is claimed is:

1. A rotary valve system for a combustion engine having a block defining a plurality of in-line combustion chambers, said system comprising;

a plurality of rotors each having a passage therethrough, shaft means extending through the passage in each rotor for commonly supporting said plurality of rotors in-line with a rotor being associated with and disposed above each combustion chamber, means for supporting said shaft means, a housing securable to the top of the block and including means defining a recess for receiving each of the rotors, means defining an intake passage, means defining an exhaust passage an means defining a port communicating from the recess to the associated combustion chamber, said rotors each having a recess permitting communication between the intake or exhaust passages and the port in predetermined positions of the rotor, means for driving said shaft means and in turn said rotors including a timing gear disposed on the shaft means at one end thereof, a plurality of thrust means one being associated with each rotor, a plurality of means spacedly disposed along the shaft means each for holding a thrust means with one side of the thrust means for contacting a surface of the rotor, and means disposed adjacent the one end of the shaft means for applying an axial force to the shaft means to seat the rotors in their respective recesses.

2. A rotary valve system as set forth in claim 1 wherein each said rotor has a paraboloid shape and the recess in the rotor extends about the rotor less than 180°.

3. A rotary valve system as set forth in claim 2 wherein said rotor is constructed of a pressed graphite material.

4. A rotary valve system as set forth in claim 1 wherein said means for supporting said shaft means includes bearing means.

5. A rotary valve system as set forth in claim 1 wherein said housing in part defines the combustion chamber and said port extends vertically between the rotor and combustion chamber.

6. A rotary valve system as set forth in claim 1 wherein said housing is constructed in at least two pieces including a section through which the port extends and a cap.

7. A rotary valve system as set forth in claim 6 wherein said means defining a recess for receiving the rotor includes a bushing fitted between the section containing the port and the cap.

8. A rotary valve system as set forth in claim 7 wherein said housing has means for receiving an exhaust manifold and an intake manifold.

9. A rotary valve system as set forth in claim 1 wherein said rotor has a pair of diametrically disposed recesses.

10. A rotary valve system as set forth in claim 1 including means for adjusting the applied axial force.

11. A rotary valve system as set forth in claim 10 wherein said means for applying an axial force includes cover means fixed in position relative to the housing and biasing means disposed between the inner surface of the cover means and the timing gear.

12. A rotary valve system as set forth in claim 11 wherein said biasing means includes a recessed washer contacting the cover means, a spring positioned in the recessed washer and extending toward the timing gear and a thrust bearing engaged by the spring and disposed between the spring and timing gear.

13. A rotary valve system as set forth in claim 12 wherein said means for adjusting the applied axial force includes an adjusting screw threadedly received through an opening in the cover means with one end of the adjusting screw for contacting the recessed washer and a lock nut on the other end of the adjusting screw contacting the outer surface of the cover means.

14. A rotary valve system as set forth in claim 13 wherein each thrust means includes a pair of thrust washers spaced by a thrust spring and each said means for holding a thrust means includes a snap spring which fits in a circumferential groove in the shaft means, said shaft means being a splined shaft supported adjacent opposite ends by bearing means.

15. A rotary valve system for a combustion engine having a block defining a plurality of in-line combustion chambers, said system comprising;

a plurality of rotors each having a passage therethrough having a paraboloid shape and constructed of a pressed graphite material, shaft means extending through the passage in each rotor and for commonly supporting said plurality of rotors in-line with a rotor being associated with and disposed above each combustion chamber, means for locking the rotors to the shaft means against relative rotational movement therebetween, means for supporting said shaft means, a head secured to the top of the block and including recessed means defining a plurality of paraboloid-shaped rotor seats each for receiving a rotor with each rotor having a paraboloid surface engaging its respective seat, means defining an intake passage, means defining an exhaust passage and means defining a port communicating from the recessed means to the associated combustion chamber, said rotors each having a recess in the paraboloid surface permitting communication between the intake or exhaust passages and the port in predetermined positions of the rotor, means for driving said shaft means and in turn said rotors, and means disposed at one end of the shaft means for applying an axial force to the shaft means to seat the rotors in their respective seats.

16. A rotary valve system as set forth in claim 15 including means for adjusting the applied force by urging the shaft means axially relative to the housing.

17. A rotary valve system as set forth in claim 16 including a plurality of thrust means one being associated with each rotor and for urging each rotor toward its seat.

18. A rotary valve system as set forth in claim 17 including a plurality of means spacedly disposed along the shaft means for holding each thrust means with one side of the thrust means for contacting a surface of the rotor.

* * * * *